US011252794B2

(12) United States Patent
Thurk et al.

(10) Patent No.: US 11,252,794 B2
(45) Date of Patent: Feb. 15, 2022

(54) SYSTEMS, DEVICES, AND METHODS FOR CONTROLLING AN LED LIGHT SOURCE BASED ON A COLOR TEMPERATURE SCALE FACTOR

(71) Applicant: Electronic Theatre Controls, Inc., Middleton, WI (US)

(72) Inventors: John Thurk, Fitchburg, WI (US); Joe Garvey, Middleton, WI (US); Andrew Slade, Middleton, WI (US); Derek Krouze, Middleton, WI (US)

(73) Assignee: Electronic Theatre Controls, Inc., Middleton, WI (US)

( * ) Notice: Subject to any disclaimer, the term of this patent is extended or adjusted under 35 U.S.C. 154(b) by 32 days.

(21) Appl. No.: 16/568,577

(22) Filed: Sep. 12, 2019

(65) Prior Publication Data

US 2020/0314974 A1 Oct. 1, 2020

Related U.S. Application Data

(60) Provisional application No. 62/826,432, filed on Mar. 29, 2019.

(51) Int. Cl.
*H05B 45/10* (2020.01)
*H05B 45/20* (2020.01)

(52) U.S. Cl.
CPC ..... *H05B 45/10* (2020.01); *H05B 45/20* (2020.01)

(58) Field of Classification Search
CPC ..... H05B 45/10; H05B 45/20; H05B 45/3577
See application file for complete search history.

(56) References Cited

U.S. PATENT DOCUMENTS 5,350,977 A 9/1994 Hamamoto et al.
7,015,655 B2 3/2006 Kamoi et al.
(Continued)

FOREIGN PATENT DOCUMENTS

CN 104079909 A 10/2014
EP 2672785 A2 12/2013
(Continued)

OTHER PUBLICATIONS

Combined Examination and Search Report issued from the United Kingdom Patent Office for related Application No. GB2004229.7 dated Sep. 9, 2020 (7 Pages).
(Continued)

*Primary Examiner* — Raymond R Chai
(74) *Attorney, Agent, or Firm* — Michael Best & Friedrich LLP

(57) ABSTRACT

A light fixture is configured to produce an output via a driver circuit to drive an array of LED light sources. Controlling the light fixture includes receiving a first light intensity value related to a light intensity value for the array of LED light sources, determining a first dimming curve based on the first light intensity value and a color temperature value to determine a first value, receiving a second light intensity value related to a light intensity value for the array of LED light sources at which the color temperature value for the output of the light fixture is achieved, wherein the second light intensity value is different than the first light intensity value, determining a second dimming curve based on the second light intensity value and the color temperature value to determine a second value, wherein the second dimming curve is different than the first dimming curve.

20 Claims, 10 Drawing Sheets

(56) References Cited

U.S. PATENT DOCUMENTS

| | | | | |
|---|---|---|---|---|
| 7,423,387 | B2 | 9/2008 | Robinson et al. | |
| 8,436,549 | B2 | 5/2013 | Hasnain | |
| 9,133,990 | B2 | 9/2015 | Lee et al. | |
| 9,719,642 | B1 | 8/2017 | Macias | |
| 9,723,680 | B2 | 8/2017 | Pope et al. | |
| 9,883,564 | B2 | 1/2018 | Ciccarelli et al. | |
| 9,992,832 | B2 | 6/2018 | Weiss et al. | |
| 10,076,011 | B1 * | 9/2018 | Amidi | H05B 47/18 |
| 10,159,131 | B1 | 12/2018 | Chaimberg et al. | |
| 2011/0037390 | A1 | 2/2011 | Ko et al. | |
| 2012/0038291 | A1 | 2/2012 | Hasnain | |
| 2013/0020956 | A1 | 1/2013 | Zhang et al. | |
| 2013/0069561 | A1 | 3/2013 | Melanson et al. | |
| 2013/0082624 | A1 * | 4/2013 | Brassfield | H05B 45/14 315/297 |
| 2013/0328503 | A1 * | 12/2013 | Toda | H05B 47/10 315/297 |
| 2014/0312777 | A1 * | 10/2014 | Shearer | H05B 47/105 315/151 |
| 2014/0333216 | A1 | 11/2014 | Zhang et al. | |
| 2016/0157318 | A1 | 6/2016 | Yadav et al. | |
| 2019/0182921 | A1 * | 6/2019 | Li | H05B 45/10 |
| 2020/0092960 | A1 * | 3/2020 | Zhai | H05B 45/24 |

FOREIGN PATENT DOCUMENTS

| | | | |
|---|---|---|---|
| WO | 2008/142622 | A1 | 11/2008 |
| WO | 2017/189571 | A1 | 11/2017 |
| WO | 2019/165386 | A1 | 8/2019 |

OTHER PUBLICATIONS

Eufy Lumos Smart Bulb by Anker, https://www.amazon.com/dp/B07177X95T/?tag=web_eufy_us-20, available as early as Mar. 22, 2019.

Color Select Turntable White, http://www.usailighting.com/color-select, available as early as Oct. 11, 2014.

Examination Report issued from the United Kingdom Patent Office for related Application No. GB2004229.7 dated May 21, 2021 (3 Pages).

Examination Report issued from the United Kingdom Patent Office for related Application No. GB2004229.7 dated Aug. 27, 2021 (4 Pages).

* cited by examiner

SYSTEMS, DEVICES, AND METHODS FOR CONTROLLING AN LED LIGHT SOURCE BASED ON A COLOR TEMPERATURE SCALE FACTOR

RELATED APPLICATIONS

This application claims the benefit of U.S. Provisional Patent Application No. 62/826,432, titled "SYSTEMS, DEVICES, AND METHODS FOR CONTROLLING AN LED LIGHT SOURCE BASED ON A COLOR TEMPERATURE SCALE FACTOR," filed Mar. 29, 2019, the entire content of which is hereby incorporated by reference.

FIELD

Embodiments described herein relate to controlling an output of a light fixture.

BACKGROUND

The color temperature of a white-light light source (e.g., an incandescent light bulb) corresponds to the temperature of an ideal black-body radiator that radiates light of a comparable hue, and is identified in units of absolute temperature, Kelvin ("K"). Color temperatures of approximately 5,000K or greater are commonly referred to as cool colors, and color temperatures between approximately 2,700K and 3,000K are commonly referred to as warm colors. The light output by an incandescent light bulb is thermal radiation and approximates an ideal black-body radiator. The color temperatures associated with the incandescent light bulb follow the Planckian locus through a particular color space (e.g., the CIE xyY color space) from low color temperatures (i.e., warm colors) to high color temperatures (i.e., cool colors). Color temperature is a convenient way to describe the color output of an incandescent light bulb or other similar white-light light sources.

SUMMARY

Although color temperature is convenient for describing color output, color temperature is typically altered based on the intensity value associated with a light source. For example, a color temperature of a light source at an intensity value of 100% is noticeably different than a color temperature of a light source at an intensity value of 50%.

Embodiments described herein provide systems, devices, and methods for controlling an output of a light fixture. The light fixture includes four or more light sources. The light fixture is configured to produce an output that achieves a desired color temperature at a desired light intensity. A controller receives input parameters corresponding to the desired color temperature and the desired intensity. A relationship between color temperature and intensity is then used to determine a color temperature scale factor. The color temperature scale factor is used to determine the current at which the light sources will be driven. As intensity is modified, the controller is configured to modify the current at which the light sources are driven based on the color temperature scale factor.

According to some embodiments, a light fixture is configured to produce an output. The light fixture includes an array of light-emitting diode ("LED") light sources, a driver circuit, and a controller. The array of LED light sources corresponds to a color channel of the light fixture. The driver circuit is configured to drive the array of LED light sources.

The controller includes computer executable instructions stored in the computer readable medium for controlling operation of the light fixture. Controlling operation of the light fixture includes receiving a first light intensity value related to a light intensity value for the array of LED light sources at which a color temperature value for the output of the light fixture is achieved. Controlling operation of the light fixture also includes determining a first dimming curve based on the first light intensity value and the color temperature value. Controlling operation of the light fixture also includes determining a first value for a first drive signal based on the first dimming curve. Controlling operation of the light fixture also includes generating a first control signal to cause the driver circuit to drive the array of LED light sources at the first value for the first drive signal. Controlling operation of the light fixture also includes receiving a second light intensity value related to a light intensity value for the array of LED light sources at which the color temperature value for the output for the light fixture is achieved, wherein the second light intensity value is different than the first light intensity value. Controlling operation of the light fixture also includes determining a second dimming curve based on the second light intensity value and the color temperature value, wherein the second dimming curve is different than the first dimming curve. Controlling operation of the light fixture also includes determining a second value for a second drive signal based on the second dimming curve. Controlling operation of the light fixture also includes generating a second control signal to cause the driver circuit to drive the array of LED light sources at the second value for the second drive signal.

According to some embodiments, a system controls an output of each of a plurality of light fixtures. The system includes a light fixture and a controller. The light fixture is configured to produce an output. The light fixture includes an array of light-emitting diode ("LED") light sources and a driver circuit. The array of LED light sources corresponds to a color channel of the light fixture. The driver circuit is configured to drive the array of LED light sources. The controller is configured to generate a drive signal related to a drive signal value for the array of LED light sources. The controller includes computer executable instructions stored in the computer readable medium for controlling operation of the light fixture. Controlling operation of the light fixture includes receiving a first light intensity value related to a light intensity value for the array of LED light sources at which a color temperature value for the output of the light fixture is achieved. Controlling operation of the light fixture also includes determining a first dimming curve based on the first light intensity value and the color temperature value. Controlling operation of the light fixture also includes determining a first value for a first drive signal based on the first dimming curve. Controlling operation of the light fixture also includes generating a first control signal to cause the driver circuit to drive the array of LED light sources at the first value for the first drive signal. Controlling operation of the light fixture also includes receiving a second light intensity value related to a light intensity value for the array of LED light sources at which the color temperature value for the output for the light fixture is achieved, wherein the second light intensity value is different than the first light intensity value. Controlling operation of the light fixture also includes determining a second dimming curve based on the second light intensity value and the color temperature value, wherein the second dimming curve is different than the first dimming curve. Controlling operation of the light fixture also includes determining a second value for a second drive signal based on the second dimming curve. Controlling operation of the light fixture also includes generating a second control signal to cause the driver circuit to drive the array of LED light sources at the second value for the second drive signal.

According to some embodiments, a method controls a light fixture configured to produce an output. The method includes receiving a first light intensity value related to a light intensity value for an array of light-emitting diode ("LED") light sources at which a color temperature value for the output of the light fixture is achieved. The method also includes determining a first dimming curve based on the first light intensity value and the color temperature value. The method also includes determining a first value for a first drive signal based on the first dimming curve. The method also includes generating a first control signal to cause the driver circuit to drive the array of LED light sources at the first value for the first drive signal. The method also includes receiving a second light intensity value related to a light intensity value for the array of LED light sources at which the color temperature value for the output of the light fixture is achieved, wherein the second light intensity value is different than the first light intensity value. The method also includes determining a second dimming curve based on the second light intensity value and the color temperature value, wherein the second dimming curve is different than the first dimming curve. The method also includes determining a second value for a second drive signal based on the second dimming curve. The method further includes generating a second control signal to cause the driver circuit to drive the array of LED light sources at the second value for the second drive signal.

Before any embodiments are explained in detail, it is to be understood that the embodiments are not limited in its application to the details of the configuration and arrangement of components set forth in the following description or illustrated in the accompanying drawings. The embodiments are capable of being practiced or of being carried out in various ways. Also, it is to be understood that the phraseology and terminology used herein are for the purpose of description and should not be regarded as limiting. The use of "including," "comprising," or "having" and variations thereof are meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings.

In addition, it should be understood that embodiments may include hardware, software, and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic-based aspects may be implemented in software (e.g., stored on non-transitory computer-readable medium) executable by one or more processing units, such as a microprocessor and/or application specific integrated circuits ("ASICs"). As such, it should be noted that a plurality of hardware and software based devices, as well as a plurality of different structural components, may be utilized to implement the embodiments. For example, "servers" and "computing devices" described in the specification can include one or more processing units, one or more computer-readable medium modules, one or more input/output interfaces, and various connections (e.g., a system bus) connecting the components.

Other aspects of the embodiments will become apparent by consideration of the detailed description and accompanying drawings.

DETAILED DESCRIPTION

Figure 1:
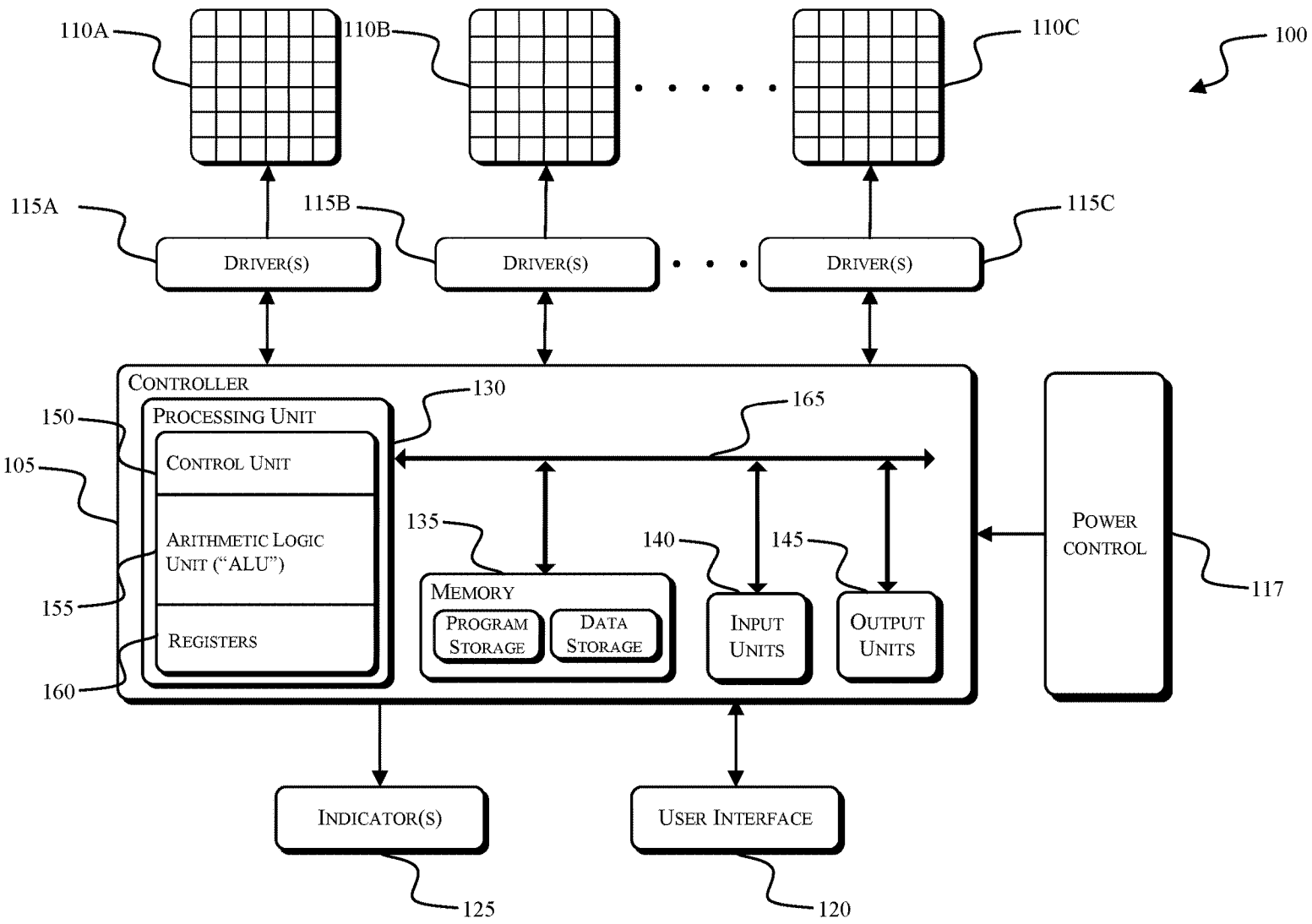
FIG. 1 is a block diagram of a light fixture, according to embodiments described herein.

In some embodiments, light fixtures are used in, for example, a theatre, a hall, an auditorium, a hotel, a cruise ship, or the like. As illustrated in FIG. 1, each light fixture 100 includes a controller 105, a plurality of light sources 110A-110C, a plurality of light source drivers or driver circuits 115A-115C, a power control circuit 117, a user interface 120, and one or more indicators 125. In some embodiments (see FIG. 2), the light fixture 100 is separate from the controller 105, with the light sources 110A-110C and the driver circuits 115A-115C contained within the light fixture 100.

The controller 105 includes a plurality of electrical and electronic components that provide power, operational control, and protection to the components and modules within the controller 105 and/or the fixture 100. For example, the controller 105 includes, among other things, a processing unit 130 (e.g., a microprocessor, a microcontroller, or another suitable programmable device), a memory 135, input units 140, and output units 145. The processing unit 130 includes, among other things, a control unit 150, an arithmetic logic unit ("ALU") 155, and a plurality of registers 160 (shown as a group of registers in FIG. 1), and is implemented using a known computer architecture (e.g., a modified Harvard architecture, a von Neumann architecture, etc.). The processing unit 130, the memory 135, the input units 140, and the output units 145, as well as the various modules connected to the controller 105 are connected by one or more control and/or data buses (e.g., common bus 165). The use of one or more control and/or data buses for the interconnection between and communication among the various modules and components would be known to a person skilled in the art in view of the invention described herein. The control and/or data buses are shown generally in FIG. 1 for illustrative purposes.

The memory 135 is a non-transitory computer readable medium and includes, for example, a program storage area and a data storage area. The program storage area and the data storage area can include combinations of different types of memory, such as a ROM, a RAM (e.g., DRAM, SDRAM, etc.), EEPROM, flash memory, a hard disk, an SD card, or other suitable magnetic, optical, physical, or electronic memory devices. The processing unit 130 is connected to the memory 135 and executes software instructions that are capable of being stored in a RAM of the memory 135 (e.g., during execution), a ROM of the memory 135 (e.g., on a generally permanent basis), or another non-transitory computer readable medium such as another memory or a disc. Software included in the implementation of the temperature controlled enclosure 100 can be stored in the memory 135 of the controller 105. The software includes, for example, firmware, one or more applications, program data, filters, rules, one or more program modules, and other executable instructions. The controller 105 is configured to retrieve from the memory 135 and execute, among other things, instructions related to the control processes and methods described herein. In other embodiments, the controller 105 includes additional, fewer, or different components.

The user interface 120 is included to control the light fixture 100. The user interface 120 is operably coupled to the controller 105 to control, for example, the output of the light sources 110A-110C, and generate and provide control signals for the driver circuits 115A-115C. The user interface 120 can include any combination of digital and analog input devices required to achieve a desired level of control for the fixture 100. For example, the user interface 120 can include a computer having a display and input devices, a touch-screen display, a plurality of knobs, dials, switches, buttons, faders, or the like. In some embodiments, the user interface is separated from the light fixture 100.

The driver circuits 115A-115C includes a first driver circuit 115A, a second driver circuit 115B, and a third driver circuit 115C, operable to control the light sources 110A-110C. The first driver circuit 115A is connected to a first array of light sources 110A for providing one or more drive signals to the first array of light sources 110A. The first array of light sources 110A corresponds, for example, to a first color channel of the light fixture 100. The second driver circuit 115B is connected to a second array of light sources 110B for providing one or more drive signals to the second array of light sources 110B. The second array of light sources 110B corresponds, for example, to a second color channel of the light fixture 100. The third driver circuit 115C is connected to a third array of light sources 110C for providing one or more drive signals to the third array of light sources 110C. The third array of light sources 110C corresponds, for example, to a third color channel of the light fixture 100. In some embodiments, each array of light sources includes light sources that correspond to multiple color channels of the light fixture (e.g., both a first color channel and a second color channel of the light fixture 100).

The power control circuit 117 supplies a nominal AC or DC voltage to the light fixture 100 or a system of light fixtures. In some embodiments, the power control circuit 117 is powered by one or more batteries or battery packs. In other embodiments, the power control circuit 117 is powered by mains power having nominal line voltages between, for example, 100V and 240V AC and frequencies of approximately 50-60 Hz. The power control circuit 117 is also configured to supply lower voltages to operate circuits and components within the light fixture 100.

Figure 2:
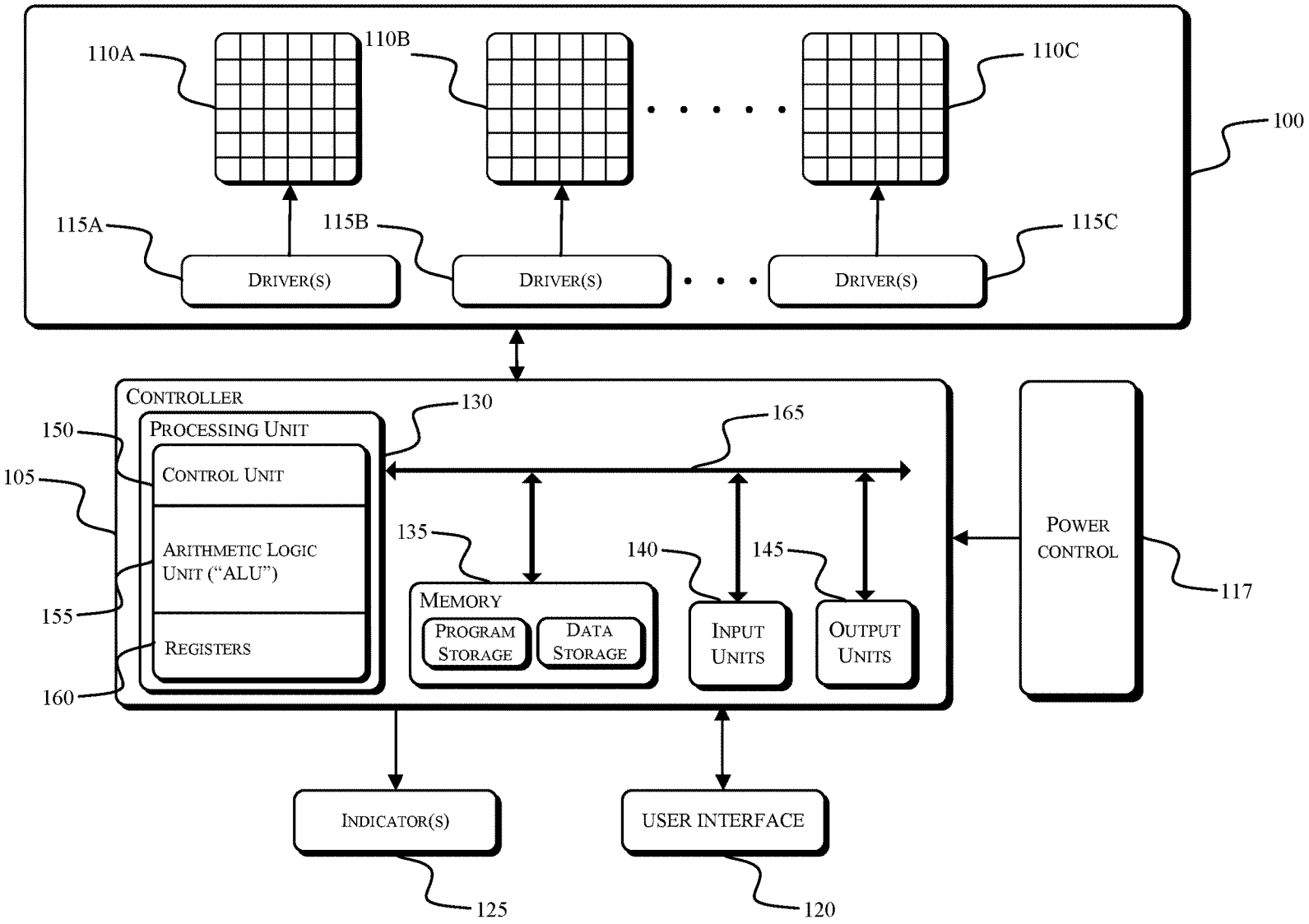
FIG. 2 is another block diagram of a light fixture, according to embodiments described herein.

As illustrated in FIGS. 1 and 2, the controller 105 is connected to light sources 110A-110C. In some embodiments, each light source 110A-110C is a chip-on-board ("COB") light source, such as the LUXEON COB manufactured by LUMILEDS. A three light source embodiment is illustrated for exemplary purposes only. In other embodiments, four or more light sources are used to further enhance the light fixtures ability to produce visible light. Conversely, in other implementations, fewer than three light sources are used (i.e., one or two light sources). The light sources 110A-110C are light emitting diodes ("LEDs"), although, in additional embodiments the light source may vary.

Figure 3:
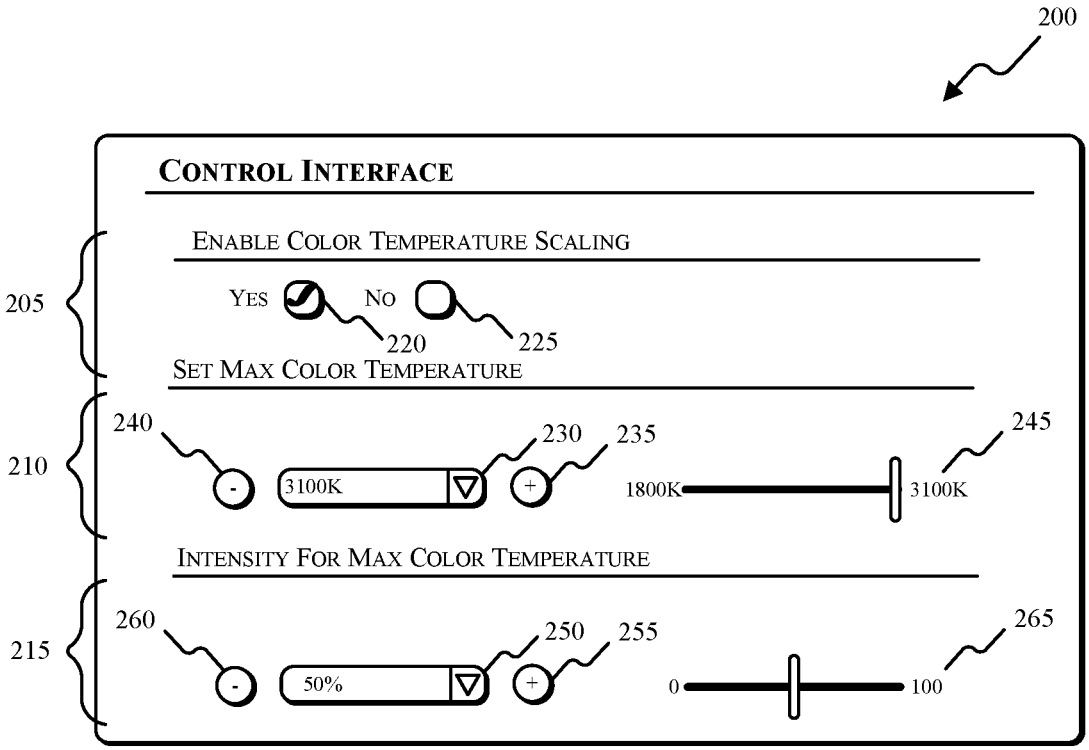
FIG. 3 is a control interface, according to embodiments described herein.

As illustrated in FIG. 3, the light fixture 100 further includes a control interface 200 for controlling a color temperature scale factor and the intensity value of the output of the light fixture 100 at which maximum color temperature is achieved. In some embodiments, the control interface 200 is included in the user interface 120. The control interface 200 is, for example, a graphical user interface ("GUI") that is displayed on a monitor or similar display. In some embodiments, the control interface 200 is a physical interface and includes one or more buttons, knobs, dials, faders, or the like.

The illustrated control interface 200 includes an enable color temperature control section 205, a set maximum color temperature control section 210, and an intensity for maximum color temperature control section 215. Although the intensity control section 215 is illustrated as being separate from, for example, target color controls (e.g., hue control, saturation control, individual light source control, etc.), the intensity control section 215 can alternatively be included with the target color controls. The enable color temperature control section 205 includes a YES checkbox 220 and a NO checkbox 225. The checkboxes 220 and 225 are used to select or deselect color temperature control (i.e., control based on a color temperature scale factor). Once enabled, the color temperature control can use a maximum color temperature setting from the set maximum color temperature control section 210 to control a maximum color temperature of the light fixture 100. An intensity setting from the intensity for maximum color temperature control section 215 can be used to set the intensity value for the light fixture at which the maximum color temperature is achieved (e.g., 50%). The intensity value for the light fixture at which the maximum color temperature is achieved is referred to as a color temperature scale factor or color temperature scaling factor.

The set maximum color temperature control section 210 includes a color temperature input portion 230, an increment button 235, a decrement button 240, and a fader 245. The color temperature input portion 230 is controlled by directly selecting and modifying a maximum color temperature setting for the output of the light fixture 100. For example, a user is able to modify or populate the color temperature input portion 230 with a desired color temperature (i.e., a value in Kelvin). The user populates the color temperature input portion 230 by entering text via a mechanical or virtual keyboard of a computer or similar processing device, and using a pointing or selection device such as a mouse to control a cursor on the display. Input signals from the keyboard and the mouse are received, processed, and translated into a visual result or action in the interface 200. For example, if the user enters text using a keyboard, the activated keys produce signals which are represented as type-written text in the interface 200. Similarly, a mouse click, which corresponds to a location of the cursor on the screen, results in selecting/deselecting the increment button 235, the decrement button 240, a dropdown menu, the position of the fader 245, etc. In other implementations, the interface 200 is accessed and controlled using a touch-screen device and a user's finger strokes or tapping are used to populate or modify the color temperature input portion 230.

Like the color temperature control section 210, the intensity control section 215 includes an intensity input portion 250, an increment button 255, a decrement button 260, and a fader 265. The intensity input portion 250 is controlled by directly selecting and modifying an intensity setting at which the maximum color temperature is achieved. For example, a user is able to modify or populate the intensity input portion 250 with a desired intensity setting or value (e.g., a percent). The intensity input portion 250 is modified or populated in a manner similar to that described above with respect to the color temperature input portion 230.

Figure 4:
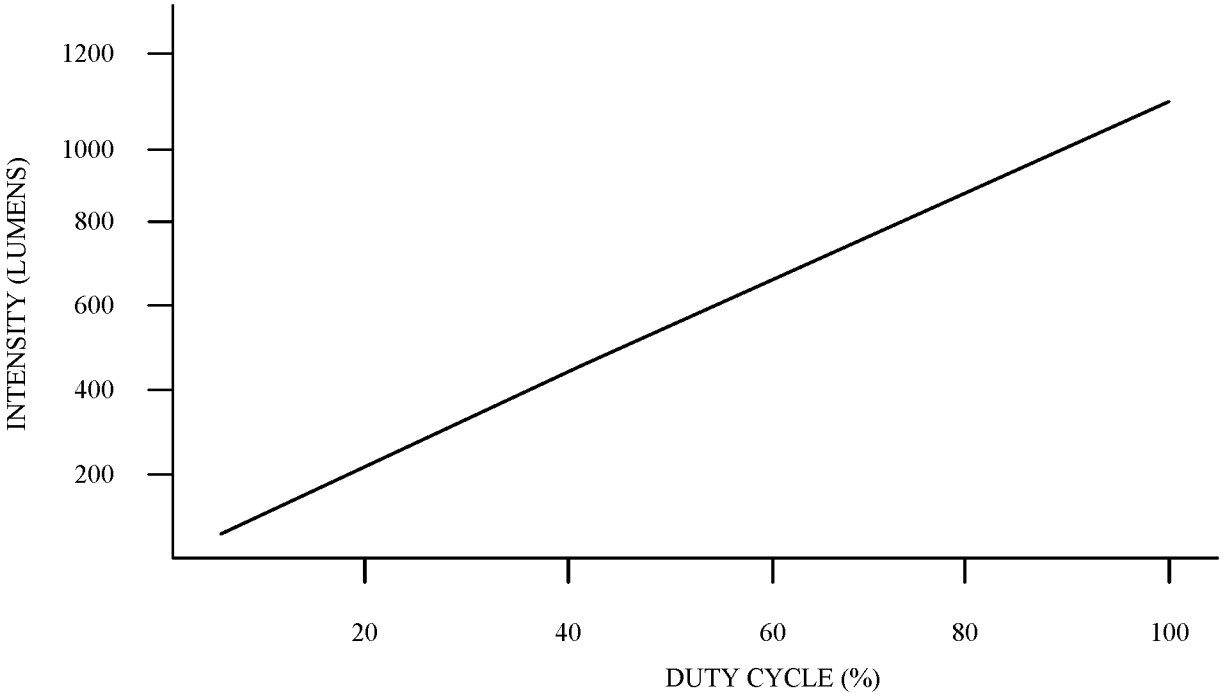
FIG. 4 is a graph of an intensity of the light fixture of FIG. 1 as a function of a duty cycle, according to embodiments described herein.

FIG. 4 illustrates light intensity, or lumen output, of the light fixture 100, as a function of duty cycle. This relationship between light intensity and duty cycle can be stored, for example, in the memory 135. Duty cycle is the ratio of pulse duration to signal period of a pulse width modulation ("PWM") control signal. By altering the duty cycle of a PWM signal, the period in which voltage is supplied to the light source is altered. In the illustrated embodiment, intensity varies linearly, or has a linear relationship, with duty cycle.

Figure 5:
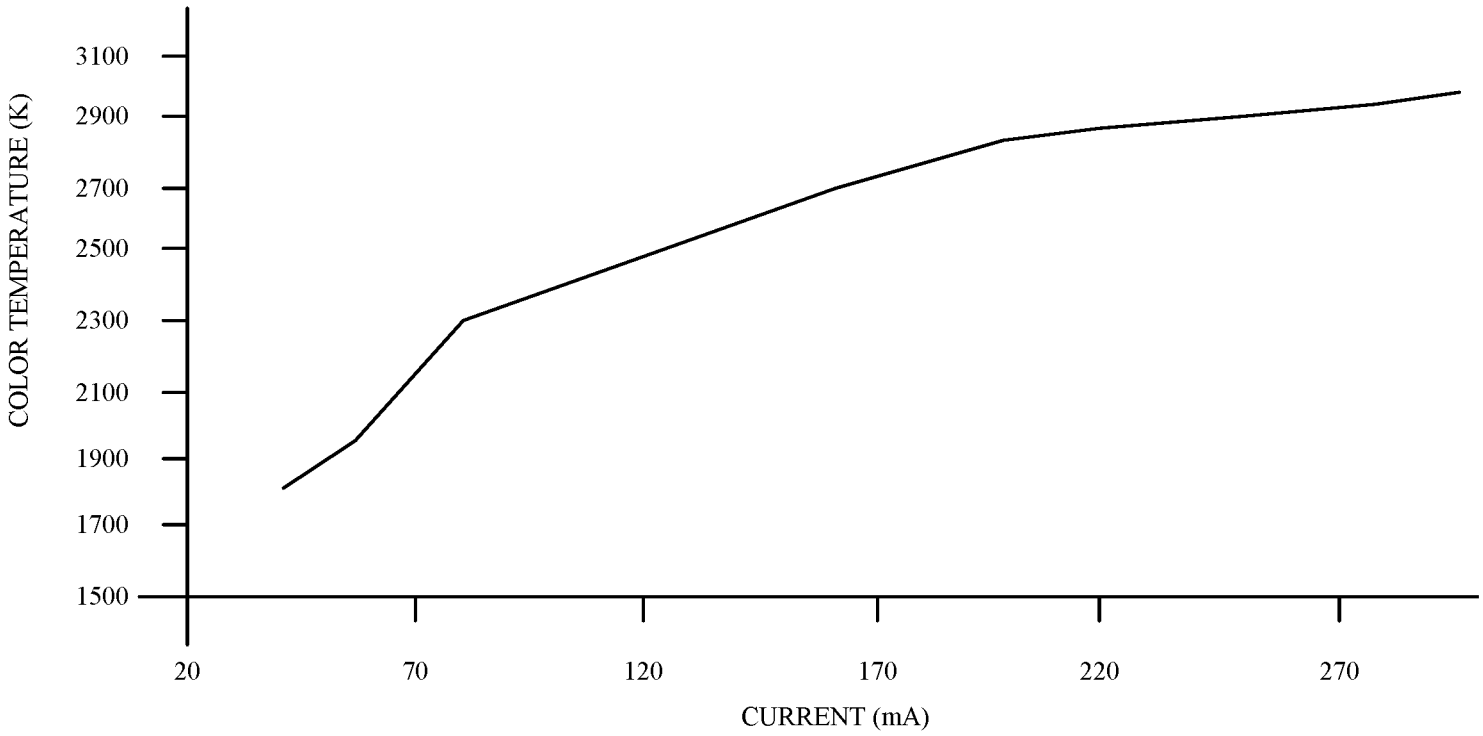
FIG. 5 is a graph of a color temperature of the light fixture of FIG. 1 as a function of a current, according to embodiments described herein.

FIG. 5 illustrates color temperature as a function of current supplied to the light sources 110A-110C. This relationship between color temperature and current can be stored, for example, in the memory 135. The color temperature is measured in degrees Kelvin, while the current is measured in milliamps. In some embodiments, the relationship between current and color temperature is approximately linear, such that increasing the current correspondingly increases the color temperature. The light sources 110A-110C are configured to emit white light and approximate ideal black-body radiators. The range of color temperature values is illustrated as 1800K-3000K, since the typical LED produces color temperatures within this range. In some embodiments, the light sources 110A-110C produce a color temperature that is less than 1800K or greater than 3000K. For example, the light sources 110A-110C can produce color temperatures between 1500K and 3300K. In addition, although the range of currents is depicted between 20 mA and 280 mA, the current range is depicted to exemplify the linear relationship between current and color temperature. In some embodiments, the current needed to produce a color temperature at a given value is different than the depicted value.

Figure 6A:
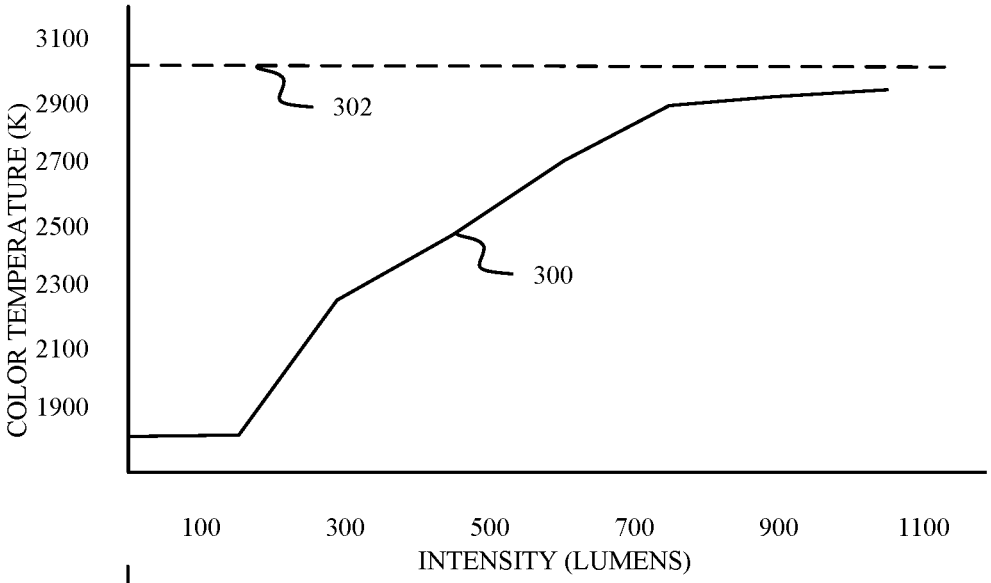
FIG. 6A is a graph of a color temperature of the light fixture of FIG. 1 as a function of an intensity of the light fixture of FIG. 1, according to embodiments described herein.
Figure 6B:
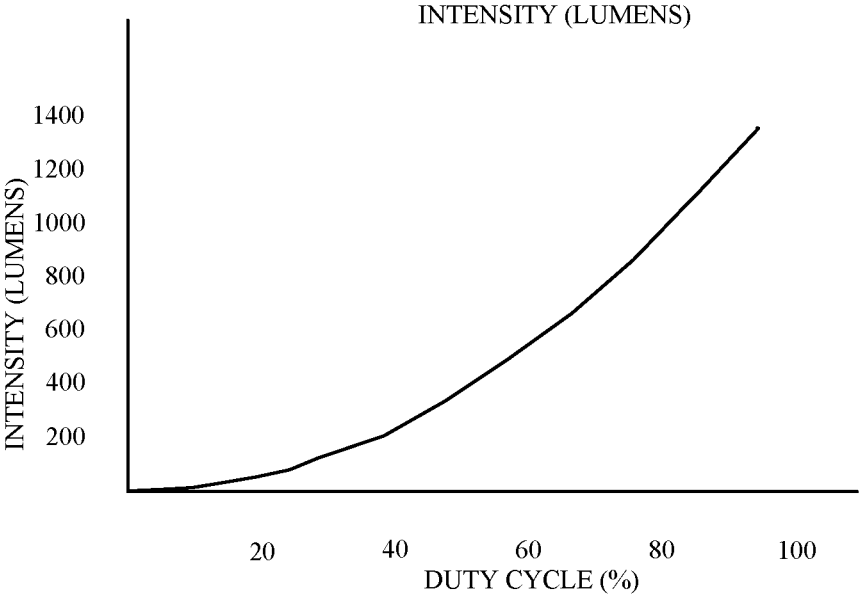
FIG. 6B is a graph of the intensity of the light fixture as a function of a duty cycle, according to the embodiment of FIG. 6A.
Figure 6C:
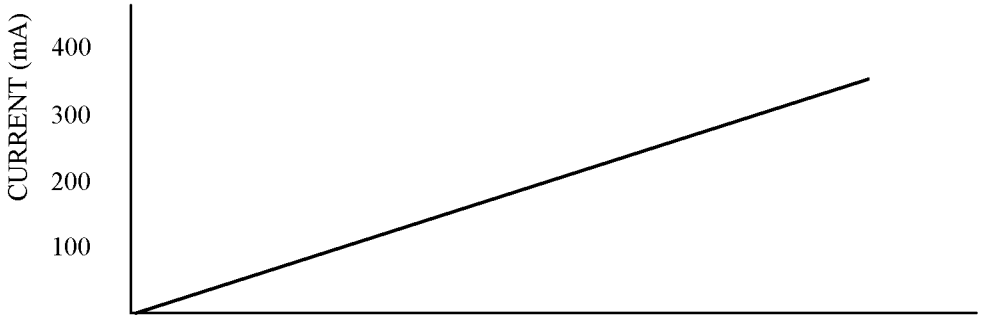
FIG. 6C is a graph of current as the color temperature of the light fixture increases, according to the embodiment of FIG. 6A.
Figure 9A:
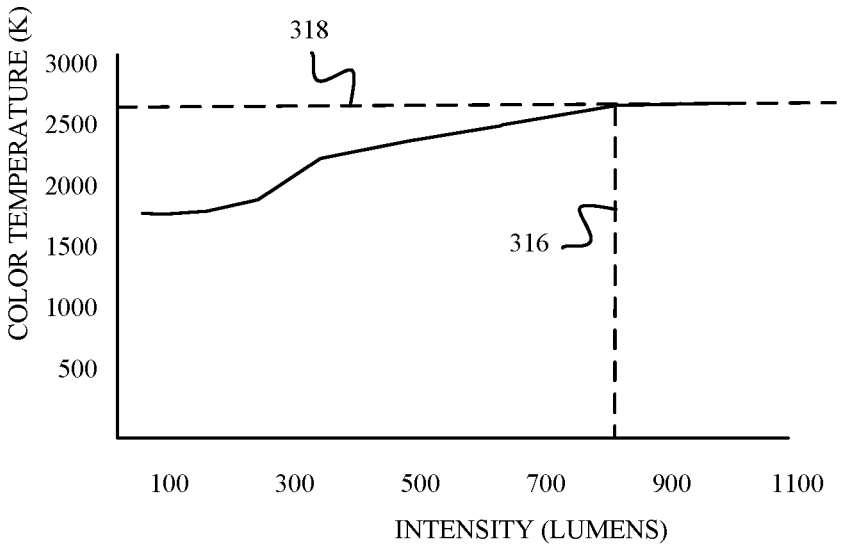
FIG. 9A is a graph of color temperature of the light fixture of FIG. 1 as a function of an intensity of the light fixture of FIG. 1, according to embodiments described herein.
Figure 9B:
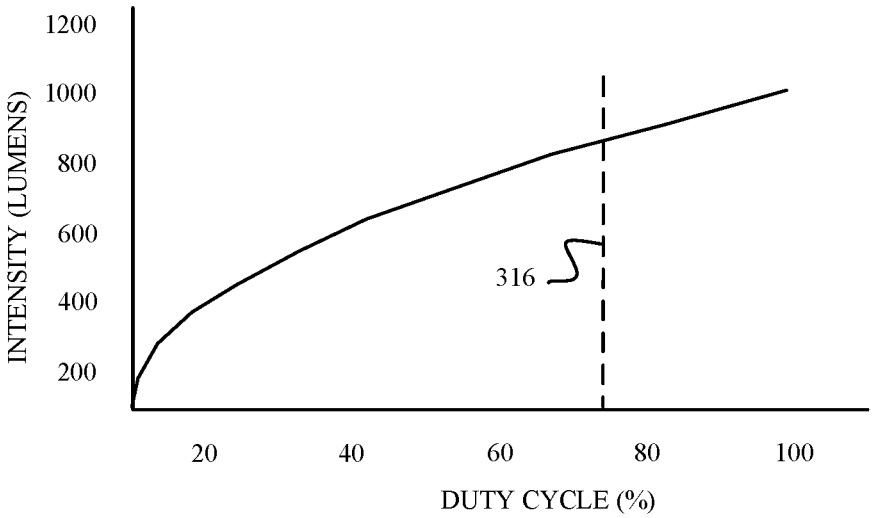
FIG. 9B is a graph of the intensity of the light fixture as a function of a duty cycle, according to the embodiment of FIG. 9A.
Figure 9C:
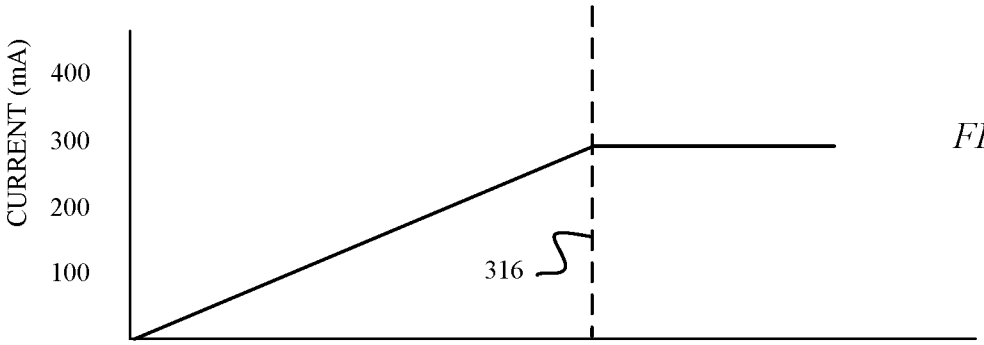
FIG. 9C is a graph of current as the color temperature of the light fixture increases, according to the embodiment of FIG. 9A.

FIG. 6A illustrates color temperature as a function of light intensity of the light fixture 100. This relationship between color temperature and light intensity can be stored, for example, in the memory 135. Line 300 depicts the relationship between intensity and color temperature (i.e., a color temperature dimming curve). The relationship illustrates a bounded exponential growth function, meaning that during certain intensities, the color temperature exponentially increases as the intensity increases. In other embodiments, the relationship between light intensity and color temperature may be represented by a parabolic function, a piecewise linear function, an inverse square function, or the like. Since the light intensity is a linear function of the duty cycle, as shown in FIG. 6B, increasing the duty cycle increases the light intensity. Similarly, increasing the current increases the color temperature, as shown in FIG. 6C. The bounded nature of the function prohibits the color temperature from increasing beyond a particular threshold value. In the illustrated embodiment, the color temperature does not increase above 3000K. In this embodiment, 3000K represents the maximum color temperature 302. For example, line 300 reaches 3000K when the line 300 reaches maximum intensity. In this embodiment, the line 300 does not reach the maximum color temperature 302 in the illustrated intensity range, therefore, the line 300 does not reach maximum intensity. Since the line 300 does not reach the maximum intensity, the entirety of the line 300 constitutes a dimming curve, or a first dimming curve. The dimming curve is the area of the line with values within the maximum color temperature 302 and the maximum intensity. In other embodiments, the maximum or limit value may be greater than or less than 3000K, as illustrated at 318 in FIG. 9A. The maximum or limit value 318 depicted in FIG. 9A is 2700K, so the controller 105 prevents the color temperature from increasing beyond 2700K. FIGS. 9B and 9C illustrate corresponding relationships between intensity, duty cycle, and current as color temperature increases to a maximum color temperature at 316.

Figure 7A:
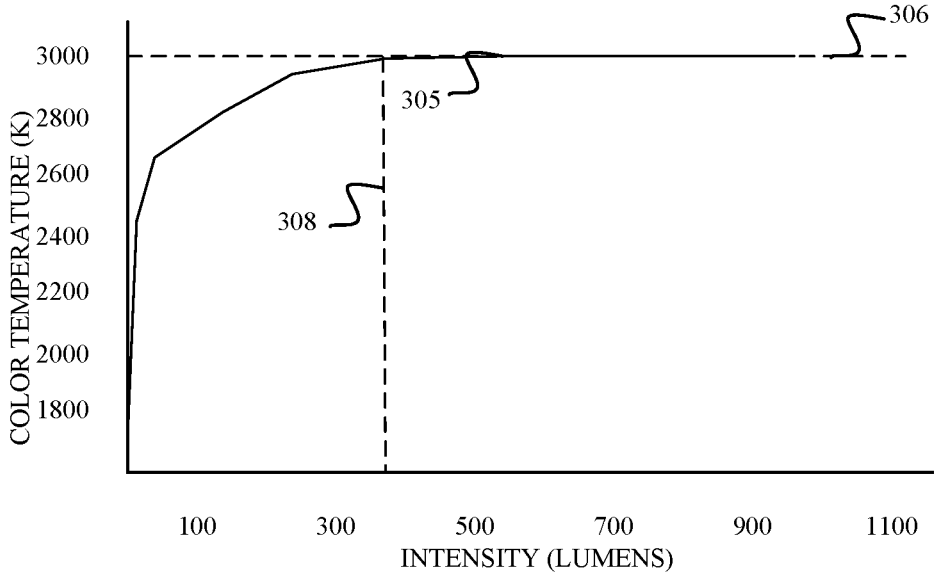
FIG. 7A is a graph of a color temperature of the light fixture of FIG. 1 as a function of an intensity of the light fixture of FIG. 1, according to embodiments described herein.
Figure 7B:
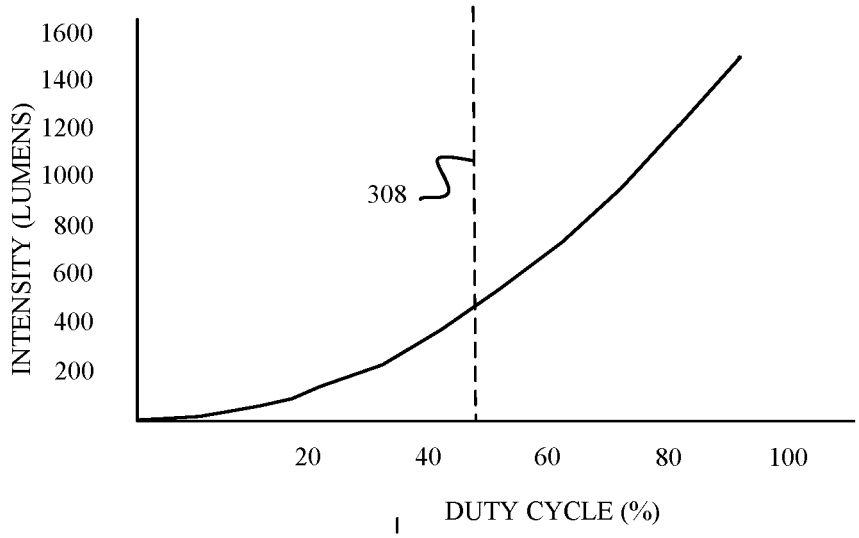
FIG. 7B is a graph of the intensity of the light fixture as a function of a duty cycle, according to the embodiment of FIG. 7A.
Figure 7C:
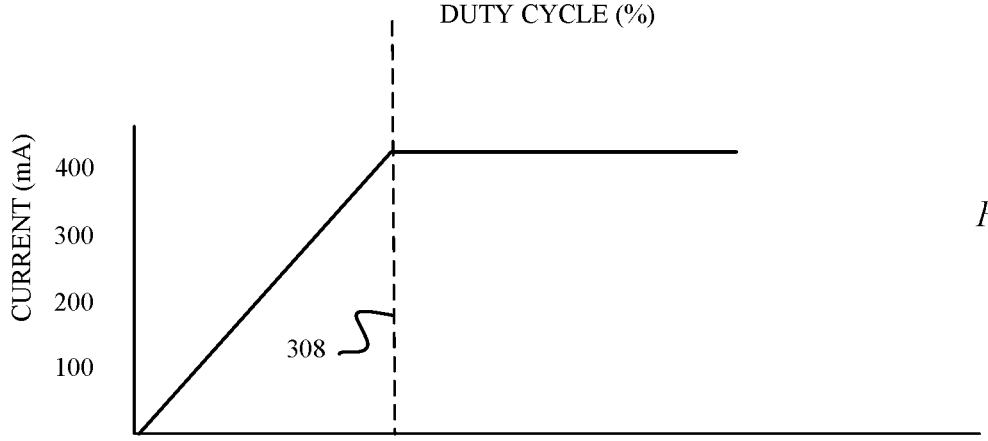
FIG. 7C is a graph of current as the color temperature of the light fixture increases, according to the embodiment of FIG. 7A.

A color temperature scale factor (see FIG. 3) is used to modify the light intensity of the light fixture 100 at which the maximum color temperature is reached by modifying the relationship between current and color temperature, as shown in FIG. 7C. The relationship between duty cycle and intensity (FIG. 7B) is unchanged by the modification to the relationship between current and color temperature. By modifying that relationship, the intensity at which the maximum color temperature is reached is reduced, as shown in line 305 in FIG. 7A. The maximum color temperature 306 for line 305 is achieved when the intensity 308 of the light fixture 100 is approximately 400 Lumens. The line 305 represents a modified color temperature dimming curve for the light fixture 100 (compared to color temperature dimming curve 300). The modified dimming curve 305 has a greater slope than the dimming curve 300 because the dimming curve 305 reaches maximum color temperature at a lower value for intensity (e.g., approximately 50% intensity). Therefore, the dimming curve 305 is different than the dimming curve 300 based on the light intensity of the light fixture 100 at which the maximum color temperature is reached.

Figure 8A:
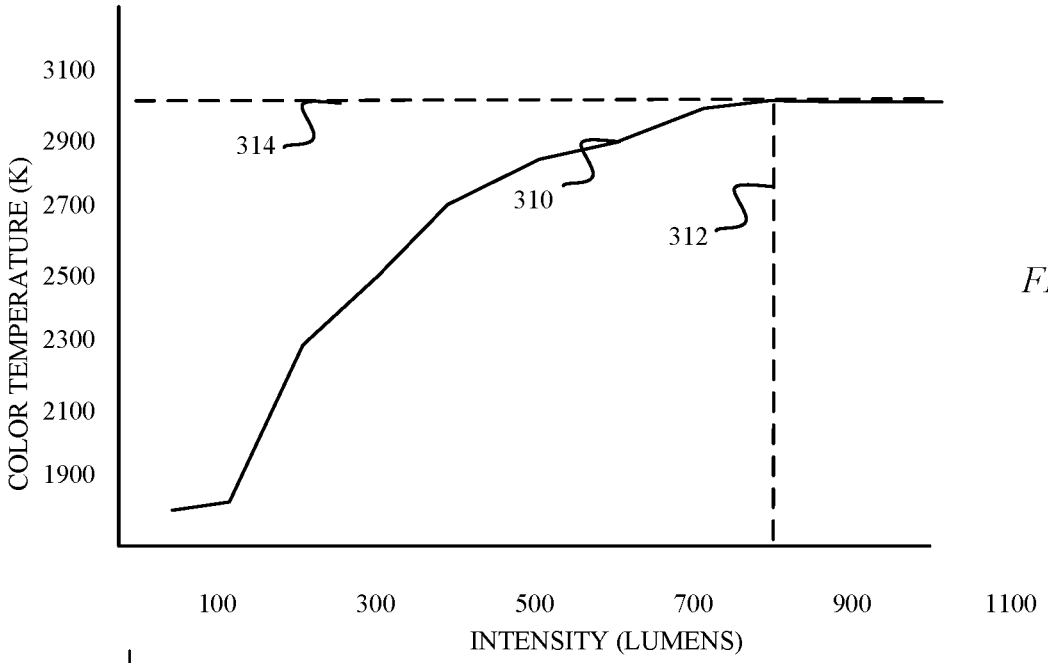
FIG. 8A is a graph of a color temperature of the light fixture of FIG. 1 as a function of an intensity of the light fixture of FIG. 1, according to embodiments described herein.
Figure 8B:
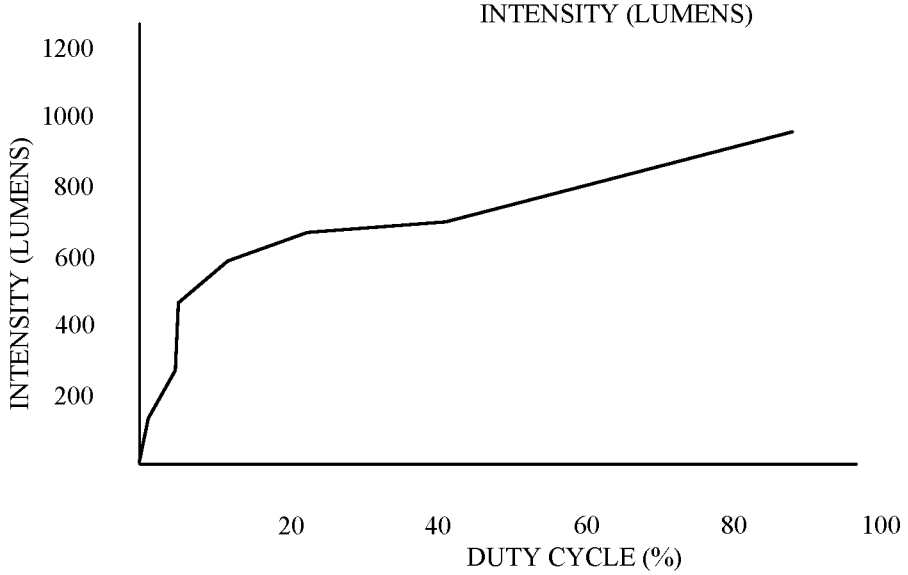
FIG. 8B is a graph of the intensity of the light fixture as a function of a duty cycle, according to the embodiment of FIG. 8A.
Figure 8C:
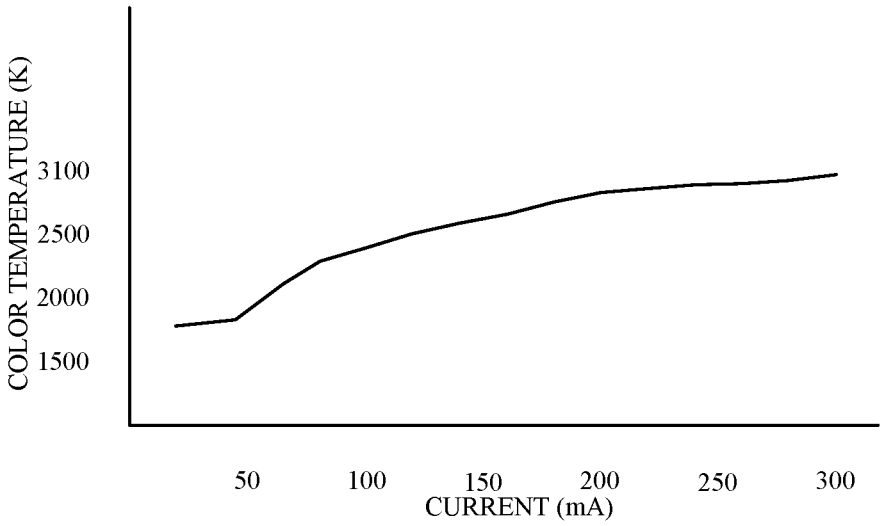
FIG. 8C is a graph of the color temperature of the light fixture as a function of a current, according to the embodiment of FIG. 8A.

In some embodiments, a similar scale factor may additionally be applied to the PWM signal that controls intensity, as demonstrated with line 310 in FIG. 8A. The maximum color temperature 314 for the line 310 is achieved when the intensity 312 is approximately 870 Lumens. The line 310 represents another modified color temperature dimming curve for the light fixture 100 (compared to color temperature dimming curves 300, 305). The modification of the relationship between duty cycle and intensity can be seen in FIG. 8B. Modifying the relationship between duty cycle and intensity can be independent of the relationship between current and color temperature, as shown in FIG. 8C. The scale factor applied to the PWM signal can be used to increase the light intensity of the light fixture 100. This is useful, for example, when a low color temperature is being produced and an inadequate light intensity is being output by the fixture 100. In some embodiments, this increase in light intensity is achieved without a corresponding increase in color temperature.

Figure 10:
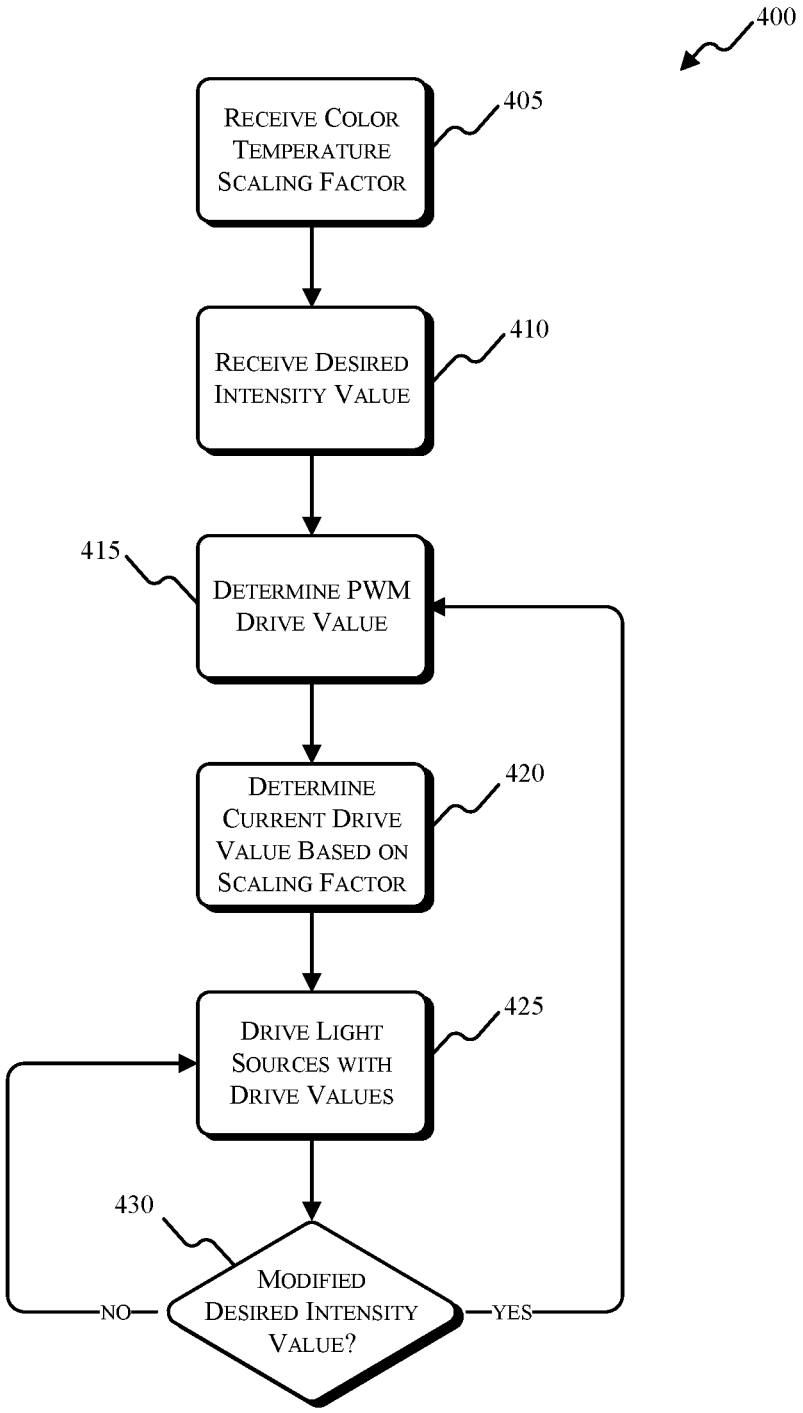
FIG. 10 is a process for controlling an output of the light fixture of FIG. 1.

FIG. 10 is a process 400 for controlling an output of the light fixture 100 to control the light intensity value at which a maximum color temperature for the fixture 100 is achieved. Various steps described herein with respect to the process 400 are capable of being executed simultaneously, in parallel, or in an order that differs from the illustrated serial manner of execution.

A color temperature scale factor and a light intensity value are inputted by a user as input parameters (steps 405 and 410). The input parameters are received by the controller 105, from a user interface (e.g., the user interface 120 or control interface 200), which allows the user to enter a desired color temperature scaling factor and a desired light intensity value. Additionally or alternatively, the controller 105 retrieves a color temperature scale factor and/or a light intensity value from the memory 135 (e.g., as part of a program or sequence of desired colors and settings).

Following step 410, the controller 105 determines a value for a PWM signal (e.g., a duty cycle that will be used to drive the light sources 110A-110C (step 415), and determines a value for a current drive signal based on the color temperature scale factor (step 420). For example, the desired light intensity value and the color temperature scale factor are compared with the stored data within the controller 105 to determine the duty cycle, or PWM drive value at step 415. Similarly, the desired light intensity value and the desired color temperature scale factor are again compared with the stored data (i.e., stored dimming curves corresponding to dimming curves 300, 305, 310, etc.) within the controller 105 to determine the current at which the light sources 110A-110C are to be driven at step 420. After the duty cycle and the current have been determined, the controller 105 provides the current drive signal to the driver circuits 115A-115C to thereby drive the light sources 110A-110C at the determined drive values (step 425). If, at step 430, the controller 105 determines that the desired intensity for the light fixture 100 has been modified, the process 400 returns to step 415 where a new PWM drive value is determined. If no modifications to desired intensity occur at step 430, the controller 105 continues to provide the current drive signal to the driver circuits 115A-115C to drive the light sources 110A-110C at the determined drive values. In some embodiments, the desired color temperature scale factor is also altered, and the controller 105 repeats steps 415, 420, and 425 with the new desired color temperature scale factor to determine the current and the duty cycle drive values.

Thus, embodiments described herein provide, among other things, systems, devices, and method for controlling an output of a light fixture to control the light intensity value at which a maximum color temperature for a fixture is achieved.

What is claimed is:

1. A light fixture configured to produce an output, the light fixture comprising:

an array of light-emitting diode ("LED") light sources corresponding to a color channel of the light fixture;

a driver circuit configured to drive the array of LED light sources; and a controller including a non-transitory computer readable medium and processing unit, the controller including computer executable instructions stored in the non-transitory computer readable medium for controlling operation of the light fixture to:

receive a first light intensity value for the array of LED light sources at which a color temperature value for the output of the light fixture is achieved, determine a first dimming curve based on the first light intensity value and the color temperature value, the first dimming curve achieving the color temperature at the first light intensity value based on the first dimming curve having a first slope, determine a first value for a first drive signal based on the first dimming curve, generate a first control signal to cause the driver circuit to drive the array of LED light sources at the first value for the first drive signal;

receive a second light intensity value for the array of LED light sources at which the color temperature value for the output of the light fixture is achieved, wherein the second light intensity value is different than the first light intensity value, modify the first dimming curve to achieve a second dimming curve based on the second light intensity value and the color temperature value, wherein the second dimming curve is different than the first dimming curve, the second dimming curve achieving the color temperature at the second light intensity value based on the dimming curve having a second slope that is different from the first slope, determine a second value for a second drive signal based on the second dimming curve, generate a second control signal to cause the driver circuit to drive the array of LED light sources at the second value for the second drive signal.

2. The light fixture of claim 1, further comprising:

a second array of LED light sources corresponding to a second color channel of the light fixture; and a second driver circuit configured to drive the second array of LED light sources.

3. The light fixture of claim 2, wherein the controller further includes computing executable instructions stored in the non-transitory computer readable medium for controlling operation of the light fixture to:

generate the first control signal to cause the second driver circuit to drive the second array of LED light sources at the first value of the first drive signal, and generate the second control signal to cause the second driver circuit to drive the second array of LED light sources at the second value for the second drive signal.

4. The light fixture of claim 1, wherein the first value corresponds to a first duty cycle, and the second value corresponds to a second duty cycle, and wherein the first duty cycle is different than the second duty cycle.

5. The light fixture of claim 4, wherein the first value corresponds to a first drive current and the second value corresponds to a second drive current, and wherein the first drive current is the same as the second drive current.

6. The light fixture of claim 1, wherein the color temperature value is between 1500 Kelvin and 3300 Kelvin.

7. The light fixture of claim 6, wherein the color temperature value is between 2700 Kelvin and 3000 Kelvin.

8. The light fixture of claim 1, wherein the first light intensity is 100% of a maximum light output of the light fixture.

9. The light fixture of claim 8, wherein the second light intensity is less than 100% and greater than 0% of the maximum light output of the light fixture.

10. The light fixture of claim 1, wherein the LED light sources are chip-on-board light sources.

11. A system for controlling an output of each of a plurality of light fixtures, the system comprising:

a light fixture configured to produce an output, the light fixture including an array of light-emitting diode ("LED") light sources corresponding to a color channel of the light fixture, and a driver circuit configured to drive the array of LED light sources; and a controller configured to generate a direct drive signal related to a direct drive signal value for one or more arrays of LED light sources, the controller including a non-transitory computer readable medium and a processing unit, the controller including computer executable instructions stored in the non-transitory computer readable medium for controlling operation of the light fixture to:

receive a first light intensity value for the array of LED light sources at which a color temperature value for the output of the light fixture is achieved, determine a first dimming curve based on the first light intensity value and the color temperature value, the first dimming curve achieving the color temperature at the first light intensity value based on the first dimming curve having a first slope, determine a first value for a first drive signal based on the first dimming curve, generate a first control signal to cause the driver circuit to drive the array of LED light sources at the first value for the first drive signal;

receive a second light intensity value for the array of LED light sources at which the color temperature value for the output of the light fixture is achieved, wherein the second light intensity value is different than the first light intensity value, modify the first dimming curve to achieve a second dimming curve based on the second light intensity value and the color temperature value, wherein the second dimming curve is different than the first dimming curve, the second dimming curve achieving the color temperature at the second light intensity value based on the dimming curve having a second slope that is different than the first slope, and determine a second value for a second drive signal based on the second dimming curve, generate a second control signal to cause the driver circuit to drive the array of LED light sources at the second value for the second drive signal.

12. The system of claim 11, wherein the light fixture controller further comprises:

a second array of LED light sources corresponding to a second color channel of the light fixture; and a second driver circuit configured to drive the second array of LED light sources.

13. The system of claim 12, wherein the second driver circuit drives the second array of LED light sources at the first value for the first drive signal and the second value for the second drive signal.

14. The system of claim 11, wherein the first value corresponds to a first duty cycle, and the second value corresponds to a second duty cycle, and wherein the first duty cycle is different than the second duty cycle.

15. The system of claim 14, wherein the first value corresponds to a first drive current and the second value corresponds to a second drive current, and wherein the first drive current is the same as the second drive current.

16. The system of claim 11, wherein the first and the second slopes are measured from a midpoint of the respective first or second dimming curve to a maximum light intensity value of the respective first or second dimming curve.

17. The system of claim 16, wherein the color temperature is a maximum color temperature of the array of LED light sources.

18. A method of controlling a light fixture configured to produce an output, the method comprising:

receiving a first light intensity value for an array of light-emitting diode ("LED") light sources at which a color temperature value for the output of the light fixture is achieved, determining a first dimming curve based on the first light intensity value and the color temperature value, the first dimming curve achieving the color temperature at the first light intensity value based on the first dimming curve having the first slope, determining a first value for a first drive signal based on the first dimming curve, generate a first control signal to cause the driver circuit to drive the array of LED light sources at the first value for the first drive signal;

receiving a second light intensity value for the array of LED light sources at which the color temperature value for the output of the light fixture is achieved, wherein the second light intensity value is different than the first light intensity value, modify the first dimming curve to achieve a second dimming curve based on the second light intensity value and the color temperature value, wherein the second dimming curve is different than the first dimming curve, the second dimming curve achieving the color temperature value at the second light intensity value based on the dimming curve having a second slope that is different from the first slope, and determining a second value for a second drive signal based on the second dimming curve, generate a second control signal to cause the driver circuit to drive the array of LED light sources at the second value for the second drive signal.

19. The method of claim 18, further comprising driving a second array of LED light sources with a second driver circuit at the first value.

20. The method of claim 19, further comprising driving the second array of LED light sources with the second driver circuit at the second value.

* * * * *